US007128515B2

(12) United States Patent
Arrez et al.

(10) Patent No.: US 7,128,515 B2
(45) **Date of Patent: *Oct. 31, 2006**

(54) REFUSE RECEPTACLE LIFTER

(75) Inventors: Ramiro Arrez, Chicago, IL (US); Carlos Arrez, Berwyn, IL (US)

(73) Assignee: Perkins Manufacturing Company, La Grange, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/286,741

(22) Filed: Nov. 22, 2005

(65) Prior Publication Data

US 2006/0072991 A1 Apr. 6, 2006

Related U.S. Application Data

(63) Continuation of application No. 10/108,825, filed on Mar. 28, 2002, now Pat. No. 6,988,864.

(60) Provisional application No. 60/280,795, filed on Apr. 2, 2001.

(51) Int. Cl.
*B65F 3/04* (2006.01)

(52) U.S. Cl. ..... 414/408; 414/406; 414/421; 414/555

(58) Field of Classification Search ..... 414/403, 414/404, 406, 408, 419, 421, 555, 639
See application file for complete search history.

(56) References Cited

U.S. PATENT DOCUMENTS

| | | | |
|---|---|---|---|
| 1,475,483 | A | 11/1923 | Galuska |
| 1,763,499 | A | 6/1930 | Bolger |
| 2,480,959 | A | 9/1949 | Presnell |
| 2,824,658 | A | 2/1958 | Beasley |
| 3,032,216 | A | 5/1962 | McCarthy |
| 3,040,919 | A | 6/1962 | Nolan |
| 3,136,436 | A | 6/1964 | Erlinder et al. |

(Continued)

FOREIGN PATENT DOCUMENTS

| | | |
|---|---|---|
| AT | 243183 | 2/1965 |

(Continued)

OTHER PUBLICATIONS

Lifting Mechanism for a Sanitation Vehicle, U.S. Appl. No. 378,823, filed May 12, 1982, now abandoned (bearing production Nos. B984-1005), with photographs (dated Dec. 1981) (bearing production Nos. B1082-1097), photographs of a present version of the above cited reference (bearing production Nos. B1098-1110A), and other related documents (bering production Nos. 935-937, 939, 941-947, 948-977, 979, 981, 983, 1006-1025, and 1111-1125).

(Continued)

*Primary Examiner*—James Keenan
(74) *Attorney, Agent, or Firm*—Cook, Alex, McFarron, Manzo, Cummings & Mehler, Ltd.

(57) ABSTRACT

A refuse receptacle lifter is disclosed which is movable between a retracted and a dumping position for lifting and inverting refuse receptacles of the type including spaced apart upper and lower engagement surfaces. The lifter may include an actuator with a rotary output shaft, a lift arm attached to the rotary output shaft, an upper engagement member carried at least in part by the lift arm, a first actuator arm pivotally mounted to the lift arm and a second actuator arm pivotally mounted to the base. The actuator arms are attached to an extension assembly that carries a lower engagement member. Upon rotation of the output shaft, the upper engagement member is moved between a lower retracted position and a raised position and the lower engagement member is moved between a retracted position and an extended position, for lifting and inverting a refuse receptacle.

11 Claims, 5 Drawing Sheets

U.S. PATENT DOCUMENTS

| | | | |
|---|---|---|---|
| 3,147,870 | A | 9/1964 | Urban et al. |
| 3,170,580 | A | 2/1965 | Soyko |
| 3,211,312 | A | 10/1965 | Miller |
| 3,270,902 | A | 9/1966 | Breault |
| 3,279,633 | A | 10/1966 | Evers |
| 3,327,876 | A | 6/1967 | Kolling |
| 3,415,169 | A | 12/1968 | Naddell |
| 3,516,562 | A | 6/1970 | Knight |
| 3,576,215 | A | 4/1971 | Cline |
| 3,576,265 | A | 4/1971 | de Cordova et al. |
| 3,662,910 | A | 5/1972 | Herpich et al. |
| 3,730,365 | A | 5/1973 | Herpich et al. |
| 3,732,997 | A | 5/1973 | Reavis et al. |
| 3,738,516 | A | 6/1973 | Wells |
| 3,747,785 | A | 7/1973 | Dahlin |
| 3,762,586 | A | 10/1973 | Updike, Jr. |
| 3,773,197 | A | 11/1973 | Blakeley et al. |
| 3,804,277 | A | 4/1974 | Brown et al. |
| 3,822,802 | A | 7/1974 | Evans, Jr. |
| 3,823,973 | A | 7/1974 | Ramer |
| 3,837,512 | A | 9/1974 | Brown |
| 3,841,508 | A | 10/1974 | Ebeling et al. |
| 3,844,434 | A | 10/1974 | Blakeley et al. |
| 3,861,547 | A | 1/1975 | Sink, Sr. |
| 3,884,376 | A | 5/1975 | Rivers |
| 3,894,642 | A | 7/1975 | Shive |
| 3,901,255 | A | 8/1975 | Pettit |
| 3,931,901 | A | 1/1976 | Jones |
| 3,944,092 | A | 3/1976 | Ebeling et al. |
| 3,954,194 | A | 5/1976 | Stedman |
| 3,964,624 | A | 6/1976 | Werder |
| 3,978,999 | A | 9/1976 | Ryder |
| 4,042,137 | A | 8/1977 | Hughes et al. |
| 4,057,156 | A | 11/1977 | Thompson et al. |
| 4,090,626 | A | 5/1978 | Ebeling et al. |
| 4,091,944 | A | 5/1978 | Gollnick |
| 4,096,959 | A | 6/1978 | Schaffer |
| 4,113,125 | A | 9/1978 | Schiller |
| 4,175,903 | A | 11/1979 | Carson |
| 4,219,298 | A | 8/1980 | Stragier et al. |
| 4,227,849 | A | 10/1980 | Worthington |
| 4,230,359 | A | 10/1980 | Smith |
| 4,237,857 | A | 12/1980 | Sharp, Sr. |
| 4,295,776 | A | 10/1981 | Payne et al. |
| 4,313,707 | A | 2/1982 | Bingman et al. |
| 4,345,868 | A | 8/1982 | Rizzo et al. |
| 4,348,147 | A | 9/1982 | Helm |
| 4,363,588 | A | 12/1982 | Stickney |
| 4,365,922 | A | 12/1982 | Borders |
| 4,372,726 | A | 2/1983 | Lutz |
| 4,401,407 | A | 8/1983 | Breckenridge |
| 4,422,814 | A | 12/1983 | Borders |
| 4,427,333 | A | 1/1984 | Ebeling |
| 4,435,117 | A | 3/1984 | House |
| 4,450,828 | A | 5/1984 | Oaken et al. |
| 4,461,607 | A | 7/1984 | Smith |
| 4,461,608 | A | 7/1984 | Boda |
| 4,479,751 | A | 10/1984 | Wyman et al. |
| 4,527,939 | A | 7/1985 | Suarez |
| 4,538,951 | A | 9/1985 | Yeazel et al. |
| 4,543,028 | A | 9/1985 | Bell et al. |
| 4,548,542 | A | 10/1985 | Reese |
| 4,557,658 | A | 12/1985 | Lutz |
| 4,566,840 | A | 1/1986 | Smith |
| 4,575,300 | A | 3/1986 | George |
| 4,597,710 | A | 7/1986 | Kovats |
| 4,597,712 | A | 7/1986 | Smith |
| 4,613,271 | A | 9/1986 | Naab |
| 4,669,940 | A | 6/1987 | Engelhardt et al. |
| 4,673,327 | A | 6/1987 | Knapp |
| 4,687,405 | A | 8/1987 | Olney |
| 4,699,557 | A | 10/1987 | Barnes |
| 4,708,570 | A | 11/1987 | Smith et al. |
| 4,715,767 | A | 12/1987 | Edelhoff et al. |
| 4,722,658 | A | 2/1988 | Wurtz et al. |
| 4,726,726 | A | 2/1988 | Dossena et al. |
| 4,741,658 | A | 5/1988 | Zelinka et al. |
| 4,773,812 | A | 9/1988 | Bayne et al. |
| 4,844,682 | A | 7/1989 | Edelhoff |
| 4,872,801 | A | 10/1989 | Yeazel et al. |
| 4,909,564 | A | 3/1990 | Pfeifer et al. |
| 4,911,600 | A | 3/1990 | Zelinka et al. |
| 4,936,732 | A | 6/1990 | Naab et al. |
| 4,966,514 | A | 10/1990 | Knapp |
| 4,983,092 | A | 1/1991 | Richards |
| 4,992,018 | A | 2/1991 | Prout et al. |
| 5,002,450 | A | 3/1991 | Naab |
| 5,007,786 | A | 4/1991 | Bingman |
| 5,015,142 | A | 5/1991 | Carson |
| 5,015,143 | A | 5/1991 | Carson |
| 5,018,929 | A | 5/1991 | Carson |
| 5,024,573 | A | 6/1991 | Redding et al. |
| 5,026,104 | A | 6/1991 | Pickrell |
| 5,026,241 | A | 6/1991 | Wyman |
| 5,028,196 | A | 7/1991 | Richards |
| 5,035,563 | A | 7/1991 | Mezey |
| 5,049,026 | A | 9/1991 | Bingman et al. |
| 5,056,979 | A | 10/1991 | Niederer |
| 5,069,593 | A | 12/1991 | Zelinka et al. |
| 5,071,303 | A | 12/1991 | Carson |
| 5,071,307 | A | 12/1991 | Carson |
| 5,092,731 | A | 3/1992 | Jones et al. |
| 5,098,250 | A | 3/1992 | Carson |
| 5,114,304 | A | 5/1992 | Edelhoff et al. |
| 5,163,805 | A | 11/1992 | Mezey |
| 5,205,698 | A | 4/1993 | Mezey |
| 5,209,537 | A | 5/1993 | Smith |
| 5,230,393 | A | 7/1993 | Mezey |
| 5,257,877 | A | 11/1993 | Zelinka et al. |
| 5,266,000 | A | 11/1993 | LeBlanc |
| 5,303,841 | A | 4/1994 | Mezey |
| 5,308,211 | A | 5/1994 | Bayne |
| 5,333,984 | A | 8/1994 | Bayne et al. |
| 5,344,272 | A | 9/1994 | Nuyts |
| 5,360,310 | A | 11/1994 | Jones et al. |
| 5,391,039 | A | 2/1995 | Holtom |
| 5,466,110 | A | 11/1995 | Redding |
| 5,470,187 | A | 11/1995 | Smith et al. |
| 5,482,180 | A | 1/1996 | Smith et al. |
| 5,484,245 | A | 1/1996 | Zopf |
| 5,505,576 | A | 4/1996 | Sizemore et al. |
| 5,513,942 | A | 5/1996 | Pickrell |
| 5,551,824 | A | 9/1996 | Zanzig et al. |
| 5,562,386 | A | 10/1996 | Browning |
| 5,601,392 | A | 2/1997 | Smith et al. |
| 5,607,277 | A | 3/1997 | Zopf |
| 5,639,201 | A | 6/1997 | Curotto |
| 5,720,588 | A | 2/1998 | Graves |
| 5,720,589 | A | 2/1998 | Christenson et al. |
| 5,755,547 | A | 5/1998 | Flerchinger et al. |
| 5,769,592 | A | 6/1998 | Christenson |
| 5,775,867 | A | 7/1998 | Christenson |
| 5,791,861 | A | 8/1998 | Seelig |
| 5,797,715 | A | 8/1998 | Christenson |
| 5,807,056 | A | 9/1998 | Osborn et al. |
| 5,813,824 | A | 9/1998 | Zanzig et al. |
| 5,829,944 | A | 11/1998 | Szinte |
| 5,833,428 | A | 11/1998 | Szinte |
| 5,853,277 | A | 12/1998 | Everhart |
| 5,890,865 | A | 4/1999 | Smith et al. |
| 6,059,511 | A | 5/2000 | Anderson et al. |
| 6,095,744 | A | 8/2000 | Harrison |
| 6,139,244 | A | 10/2000 | VanRaden |
| 6,158,945 | A | 12/2000 | Anderson |

| | | | |
|---|---|---|---|
| 6,167,795 | B1 | 1/2001 | Bayne et al. |
| 6,183,185 | B1 | 2/2001 | Zanzig et al. |
| 6,293,863 | B1 | 9/2001 | Carr et al. |
| 6,325,587 | B1 | 12/2001 | Wysocki et al. |
| 6,357,988 | B1 | 3/2002 | Bayne |
| 6,413,031 | B1 | 7/2002 | Yakley et al. |
| 6,439,667 | B1 | 8/2002 | Weets et al. |
| 6,503,045 | B1 | 1/2003 | Arrez et al. |
| 6,551,046 | B1 | 4/2003 | Dorrington |
| 6,884,017 | B1 | 4/2005 | Arrez et al. |
| 6,921,239 | B1 | 7/2005 | Arrez et al. |
| 2001/0046430 | A1 | 11/2001 | Bayne |
| 2002/0119034 | A1 | 8/2002 | Arrez |
| 2002/0141854 | A1 | 10/2002 | Arrez |
| 2002/0141855 | A1 | 10/2002 | Arrez |
| 2003/0099529 | A1 | 5/2003 | Arrez |
| 2005/0095097 | A1 | 5/2005 | Arrez et al. |
| 2005/0111942 | A1 | 5/2005 | Rimsa et al. |
| 2005/0169734 | A1 | 8/2005 | Arrez et al. |

FOREIGN PATENT DOCUMENTS

| | | |
|---|---|---|
| BE | 510235 | 4/1952 |
| CA | 622499 | 6/1961 |
| CH | 358747 | 1/1962 |
| CH | 453203 | 6/1968 |
| DE | 811 456 | 8/1951 |
| DE | 844 262 | 3/1952 |
| DE | 1 226 035 | 9/1966 |
| DE | 1 236 403 | 3/1967 |
| DE | 2 146 653 | 3/1967 |
| DE | 1531763 | 1/1970 |
| DE | 2 051 270 | 10/1970 |
| DE | 30 24 081 | 1/1981 |
| DK | 82300 | 6/1954 |
| EP | 0 078 011 | 4/1983 |
| EP | 0 312 900 | 4/1989 |
| EP | 0 405 428 | 1/1991 |
| EP | 575 867 | 12/1993 |
| FR | 2 272 002 | 12/1975 |
| FR | 2 459 779 | 1/1981 |
| FR | 2 479 783 | 10/1981 |
| FR | 2 500 425 | 8/1982 |
| GB | 291709 | 6/1928 |
| GB | 2 078 196 | 1/1982 |
| GB | 2 080 757 A | 2/1982 |
| GB | 2 188 302 | 9/1987 |
| SU | 751794 | 7/1980 |
| SU | 1 253 892 | 8/1986 |
| WO | WO 83/03242 | 9/1983 |
| WO | WO 91/00231 | 1/1991 |
| WO | WO91/05721 | 5/1991 |
| WO | WO92/01612 | 2/1992 |
| WO | WO93/25457 | 12/1993 |
| WO | WO94/21540 | 9/1994 |

OTHER PUBLICATIONS

Refuse Removal Systems, Inc., "Waste Wheeler," Waste Age, 1982 (with photographs of the device bearing production Nos. B913-922).

Rubbermaid "Mobile Toter."

McKagen, World Wastes, "Supercanl Can . . . And Does," Jun. 1983, pp. 24-26.

Waste Age, Mar. 1982, pp. 31-33.

Perkins Mfg. Brochure: "The Original Rotary Tuckaway," Model D6080-20K, (2 pages).

Zöller-Kipper GMBH Brochure "Zöller System," (11 pages).

Zarn Model "D" sales brochure, printed prior to Mar. 20, 2002.

Taskmaster Lifter features/specifications from: http://www.Baynethinline.com/products_taskmaster.htm.

Bayne Brochure Thinline® Grabber Lifer, Model GTLS 1110, undated, (2 pages).

REFUSE RECEPTACLE LIFTER

This application is a continuation application of U.S. application Ser. No. 10/108,825 filed Mar. 28, 2002, now issued U.S. Pat. No. 6,988,864, which claims the benefit of Provisional Application Ser. No. 60/280,795 filed Apr. 2, 2001. Each of these applications is hereby incorporated by reference herein.

BACKGROUND OF THE INVENTION

The present invention relates generally to lifters for mounting on refuse collection vehicles or on fixed or portable refuse collection stations, or for use in other settings.

Incorporated by reference herein are also (1) co-pending U.S. patent application Ser. No. 09/731,946 by the inventors Ramiro Arrez and Carlos Arrez, filed Dec. 7, 2000, (2) Provisional Application (Ser. No. 60/271,860) by the same inventors which was filed on Feb. 27, 2001, entitled "Retractable Lifter for Refuse Container," and related regular U.S. application Ser. No. 10/081,654, filed Feb. 22, 2002, (3) U.S. Provisional Application (Ser. No. 60/280,091) by the same inventors filed on Mar. 30, 2001, entitled "Damage-Resistant Refuse Receptacle Lifter," and (4) U.S. Provisional Application (Ser. No. 60/280,092) by the same inventors filed on Mar. 30, 2001, entitled "Damage-Resistant Refuse Receptacle Lifter with Face Plate."

It is now a well known practice to employ refuse container lifters for automatically lifting and dumping large residential refuse collection containers or carts. Such lifters are typically, although not exclusively, mounted on the rear of refuse collection trucks, adjacent to the refuse hopper. Although such refuse container lifters are available in a variety of shapes and configurations, there remains a continuing need for improved, more reliable and less costly lifters.

More particularly, there continues to be a need for lifters that can be mounted at various heights and still reliably engage and lift refuse collection containers or carts. For example there is no single standard height for refuse collection vehicles or stations, and mounting height of the lifter (above ground level) may differ from one installation to another. Further, collection routes often involve travel along alleys or roads that have depressions, pot-holes or shoulders that cause frequent and unpredictable variations in the height of the lifter above the road surface. Similarly, the height of the refuse collection container itself may vary according to road surface conditions or according to the manufacturer or model of collection container.

Accordingly, it would be desirable to have a lifter that functions well in dumping collection containers in some, if not all, of these circumstances, and it is an object of this present invention to provide such a lifter.

Accordingly, it is a further object of the present invention to provide such an improved lifter suitable for dumping refuse collection carts or containers, and which may be employed in rear loader, side loader, front loader, and other applications.

BRIEF DESCRIPTION OF THE DRAWINGS AND VIEWS

DETAILED DESCRIPTION

Figure 1:
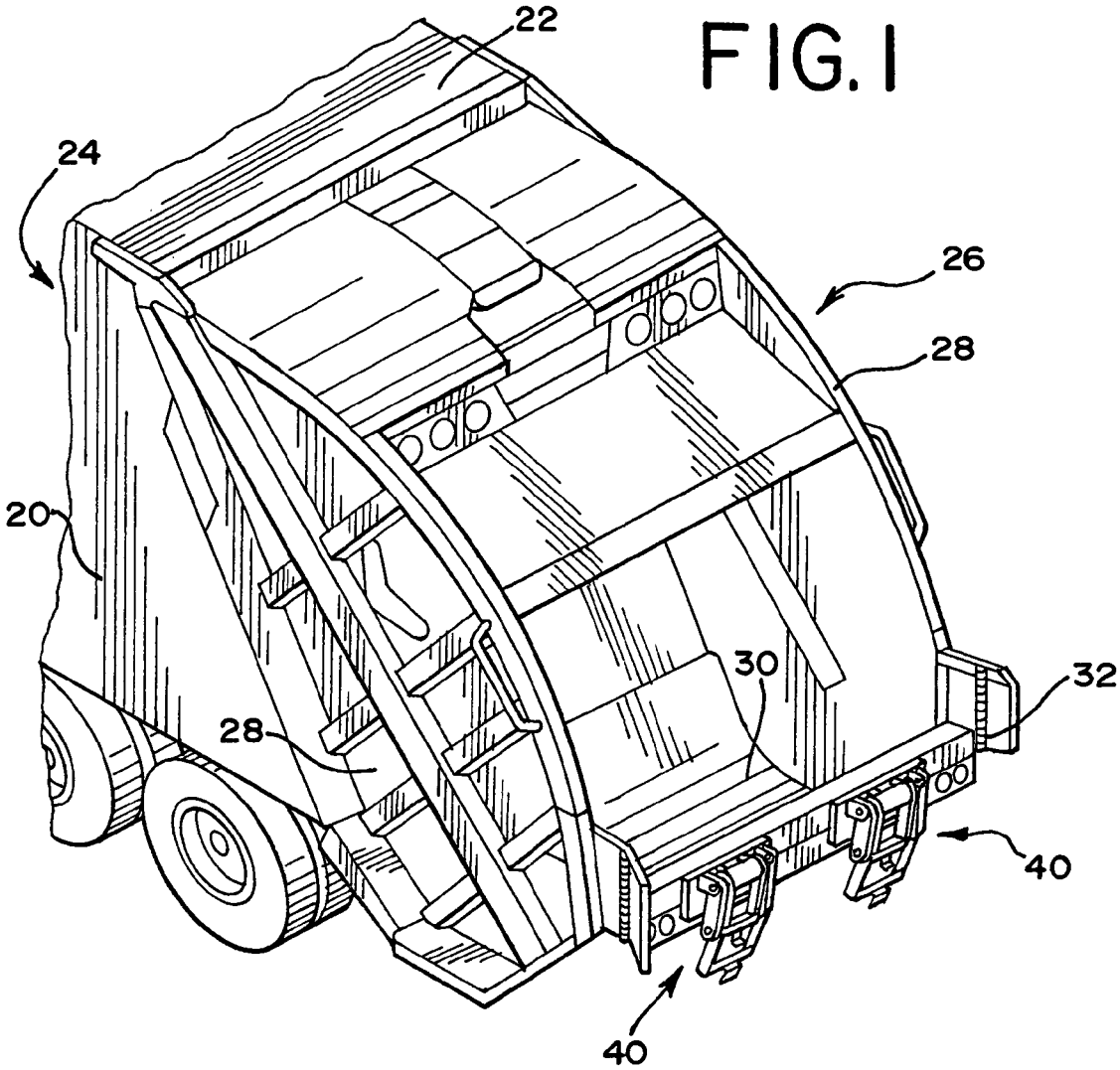
FIG. 1 is a perspective view, partially removed, of a rear-loading refuse collection truck including two lifters in accordance with the present invention.

FIG. 1 illustrates a typical rear loading refuse collection truck of the type having a pair of sidewalls 20, a top wall 22, and bottom wall (not shown) forming a refuse collection body, generally at 24. A rear load hopper assembly, generally at 26, is mounted at the back of the collection body and includes sidewalls 28 and a curved bottom hopper wall 30. The bottom hopper wall slopes upwardly toward a rearward sill or sill edge 32, over which refuse is dumped into the collection hopper. For convenience, the directions corresponding to the front and rear of the truck will be the same as those used for the present invention. Although the present invention is illustrated on a refuse collection vehicle, its utility is not limited to that application and it may be mounted on stationary or portable refuse collection stations or the like.

Figure 2:
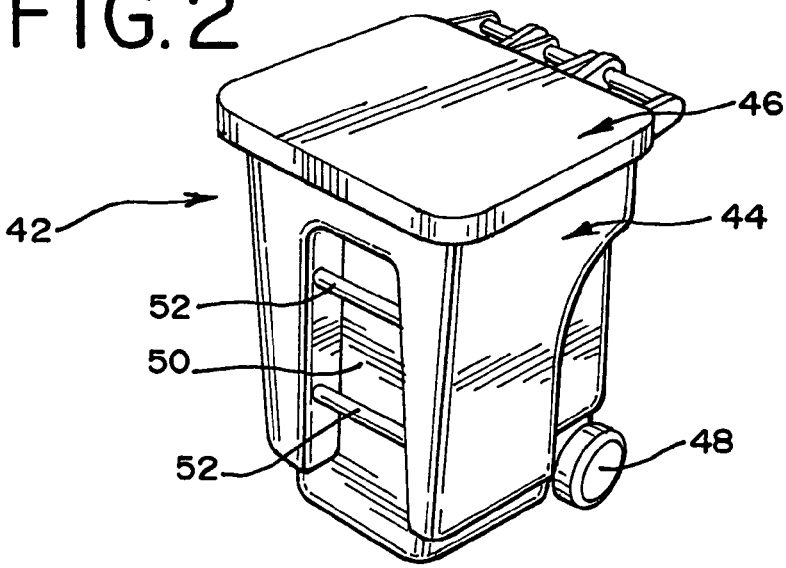
FIG. 2 is an enlarged perspective view of a typical residential refuse container used with the lifter of the present invention. Although shown using a larger scale than FIG. 1, the refuse container actually is suitable for being loaded and dumped by either one of the lifters shown in FIG. 1.

The collection truck illustrated in FIG. 1 is adapted for dumping residential style containers (as shown for example in FIG. 2). For dumping the residential style containers, the refuse collection truck in FIG. 1 has two lifters 40 embodying the present invention mounted at the rear, although only one could also be used. Also, the lifter of the present invention is not limited to rear mounting, but may also be side mounted or mounted directly on larger refuse collection containers that are either stationary or movable, for example, by refuse collection vehicle.

Before turning to a more detailed description of the lifter 40, reference is made to FIG. 2, which shows a typical residential roll out refuse collection container or cart 42 for which the present lifter is intended. The typical container 42 is made of rigid plastic construction, with a body 44 and a hinged lid 46. A pair of wheels 48 allow the container to be conveniently moved curbside or to another pickup location. The front side of the container includes a generally recessed area 50 to accommodate lifter units on the refuse collection vehicle. For cooperation with such lifters, a pair of parallel, spaced-apart lift bars 52 are firmly secured in the container body in the recessed area 50 and provide upper and lower engagement surfaces (upper and lower lift bars) for engagement by a lifter. Lid 46 is hingedly connected to the body, so that the lid is naturally opened by gravity when the container is inverted for dumping. It should be understood that refuse collection containers of the type shown, are available in a variety of styles and designs, and the present invention is not limited to any particular type style or design of refuse collection container. For example, some refuse carts have molded-in lift surfaces or areas instead of lift bars, and the lifter 40 is suited for those carts as well.

Figure 3:
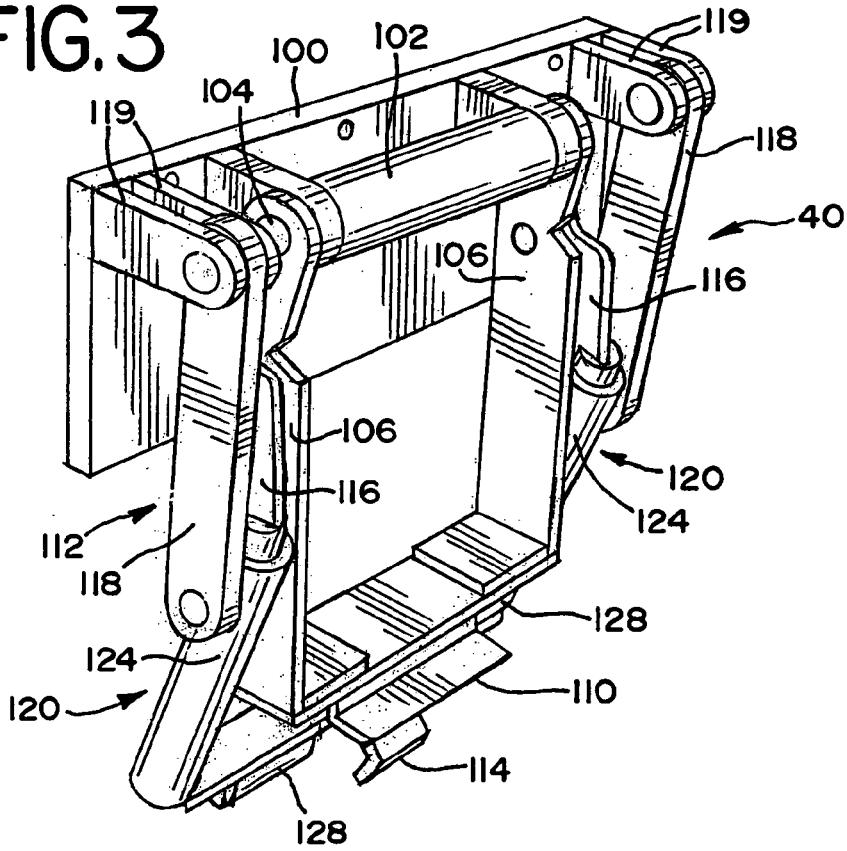
FIG. 3 is a perspective view of the lifter of FIG. 1 embodying the present invention and illustrated in a lowered or retracted position.

Turning to FIG. 3, each lifter 40 attached to the back of the truck has the same basic construction. Each lifter 40 includes a base or base plate 100 for attachment to the truck, container or lift station. A rotary hydraulic actuator 102 is welded, bolted or otherwise attached to the base, and includes a rotary output shaft 104 extending from at least one and preferably both ends. When mounted on the truck or container, the output shaft extends generally horizontally and has opposed ends that extend through each end of the cylindrical rotary actuator housing. A rotary hydraulic actuator of the type sold by Helac Corporation of Enumclaw, Wash., USA, is preferred, although other types of rotary or other actuators may be used with the present invention.

A lift or drive arm 106 is fixedly attached, as by a splined connection, to each end of the output shaft 104, so as to rotate or pivot about the output shaft axis 132 as the output shaft is rotated. There is at least one, and preferably two, lift arms having first and second ends, the first end being attached to the output shaft 104 and the terminal or second ends of the lift arms being connected by a cross member 108. The cross member mounts a saddle or hook 110 of engaging and lifting the upper bar or lift surface 52 of the refuse container or cart 40.

For capturing the cart and holding it when inverted, the lifter 40 includes a lower hook actuation assembly, generally at 112, for moving a lower hook 114 to a position over the lower bar or engagement area 52. This actuation assembly includes at least a first actuator arm 116 (and preferably two such arms), that is pivotally attached at a first end to the lift arm 106 at a location intermediate the ends of the lift arm, and a second actuator arm 118 that is pivotally attached at a first end to the base 100 by way of brackets 119. An identical actuator arm pair is employed on each side of the lifter, and description of one pair will suffice for the other as well.

Figure 4:
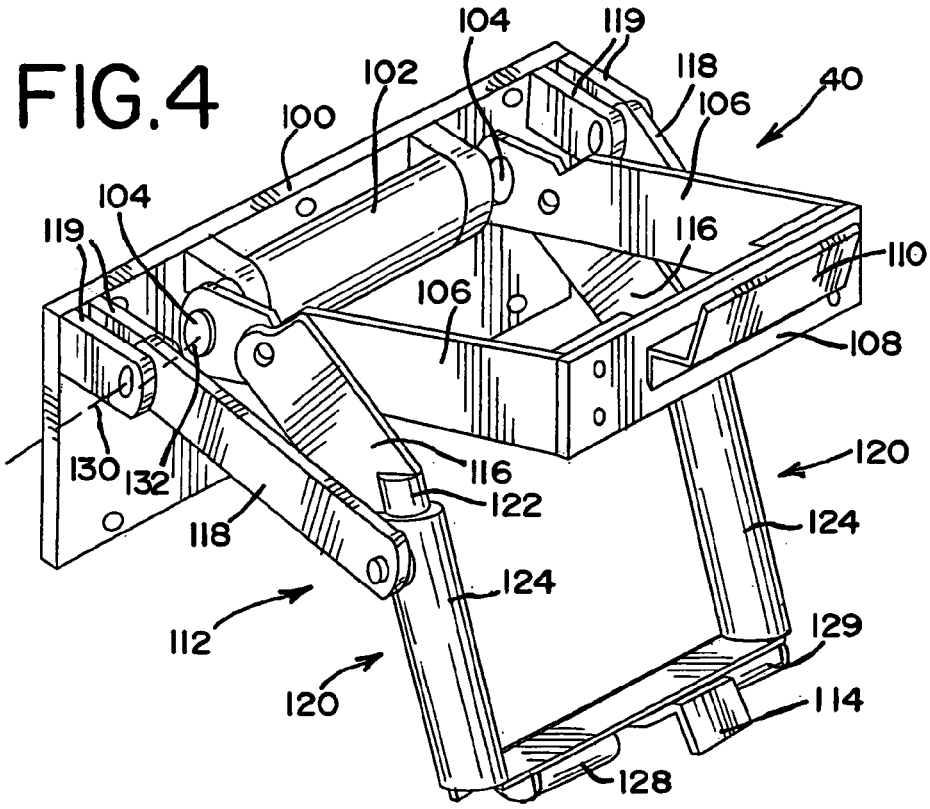
FIG. 4 is a perspective view of the lifter of FIG. 3 in an intermediate position between the lowered or retracted position of FIG. 3 and the raised or dumping position of FIG. 5.

More specifically, the first actuator arm is preferably pivotally attached to the lift arm, as seen in FIG. 4, between the first end and the mid-point of the lift arm, and near or in the proximity to the first end or to the output shaft 104.

Figure 5:
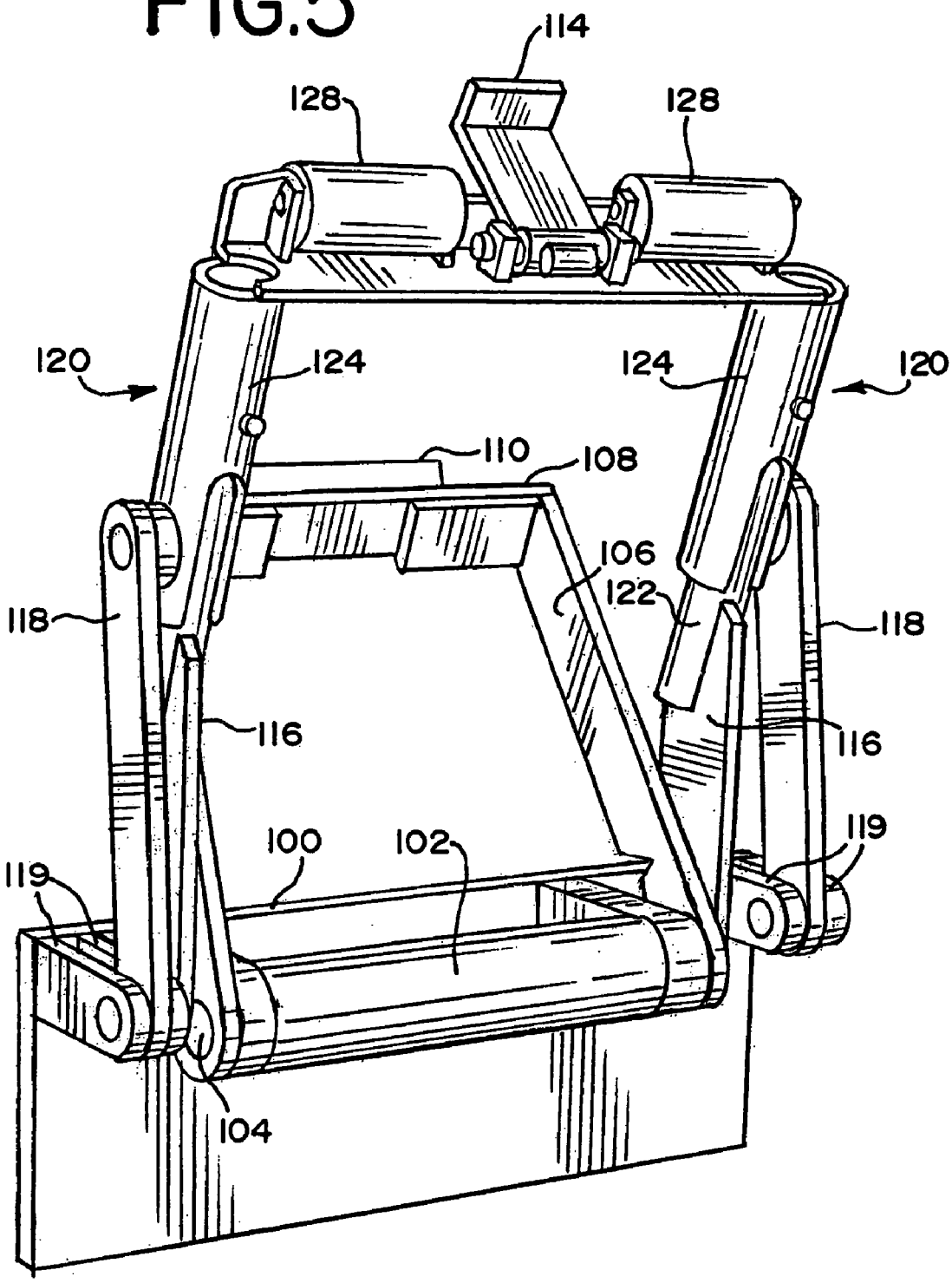
FIG. 5 is a perspective view of the lifter of FIG. 3 in a raised or dumping position.

The other or second ends of the actuator arms are cooperatively attached to an extension assembly, such as a telescoping arrangement, having first and second relatively movable members, such as inner and outer members of a telescoping assembly, generally at 120. The extension assembly is operable to move the lower hook downwardly, in a direction away from the upper hook, as the lifter rotates from the lower retracted position to the raised and inverted dumping position. More specifically, in the illustrated embodiment, the second end of the first actuator arm is fixed, as by welding or the like, to a steel rod 122 that forms the inner member of the relatively slidable or telescoping arrangement, generally at 120. The other or second end of the second actuator arm 118 is pivotally fixed to a hollow steel cylinder or sleeve 124 that forms the outer member of the relatively slidable or telescoping arrangement, and slidably receives the steel rod 122 within the bore of the cylinder. As shown more clearly in FIG. 5 and one or more of the applications incorporated by reference above, the sleeve 124 is slotted to receive the first actuator arm as the rod moves into the sleeve. These parts could, of course, be reversed without departing from the present invention.

As illustrated, cross member 126 extends between and is attached to each of the cylinders or sleeves 124. The cross member mounts the lower hook 114 for capturing the lower bar or engagement area 52 of the container 42. The hook may be spring biased and is flanked by a pair of rollers 128 for protecting the side of the cart or container against damage from the lower hook.

In operation, the elongated lift arms 106, which rotate with the output shaft of the actuator, form a fixed radius of rotation for the upper hook. In the retracted position, as seen in FIG. 4, the elongated lift arms hang nearly vertically downwardly, and the upper hook is located at the bottom end of the lift arms in proximity to the lower hook. This lower location allows the upper hook to sweep upwardly from a very low position and catch beneath the upper bar 52 or engagement surface of a container, as the lifter is rotated to a raised and inverted position. This is particularly advantageous because it allows to lifter to be mounted at different heights, depending on the particular vehicle or location where mounted, and still be very effective in lifting and dumping containers. As seen, for example in FIGS. 6 and 7, the lifter may be mounted at very different heights and still function effectively in lifting and dumping containers, due the very low position of the upper hook when the lifter is in the retracted position.

The movement of the lower hook is effected by the actuator arms 116 and 118 and the extension or telescoping assembly 120. The second actuator arms are pivotally attached to the base 100 at a pivot axis 130 spaced above and slightly rearward of the pivot axis 132 of the rotary hydraulic actuator 102. As a result of the relative spacing of the axes, when the lifter moves rearwardly and upwardly, second actuator arm effectively pushes the sleeve or cylinder 124 and the first actuator arm effectively pulls on the inner rod 122, such that the second cylinder or sleeve 124 slides downwardly or outwardly along the steel rod 122, telescoping apart and increasing the distance between the upper and lower hooks 110 and 114 to capture the container or cart by capturing the lower bar or engagement surface 52 under the lower hook 114.

Figure 6:
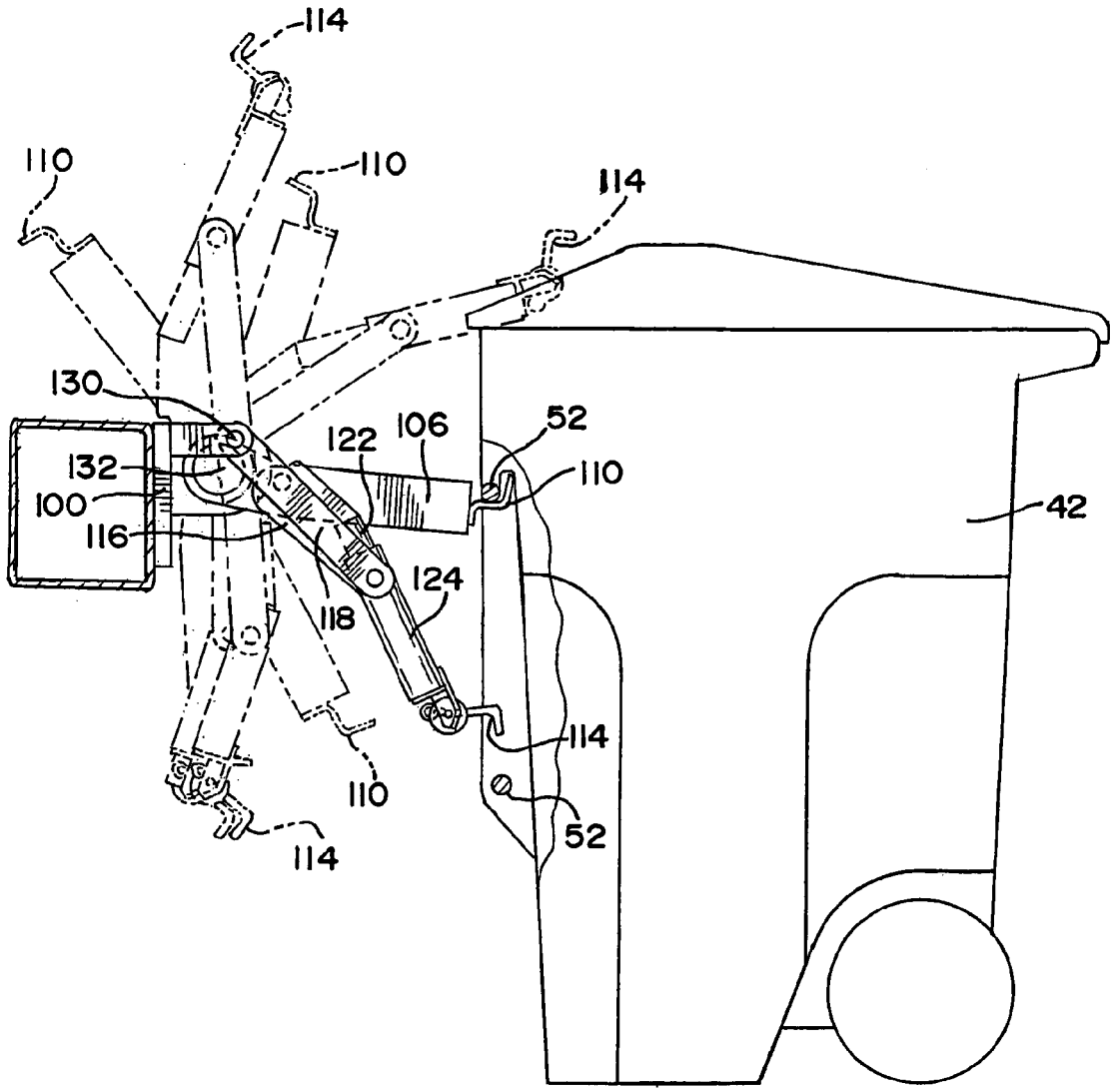
FIG. 6 is a side view of the lifter of FIG. 3, showing the lifter mounted at one vertical height and in progressive positions between a lowered or retracted position and a raised position for dumping a container or cart.
Figure 7:
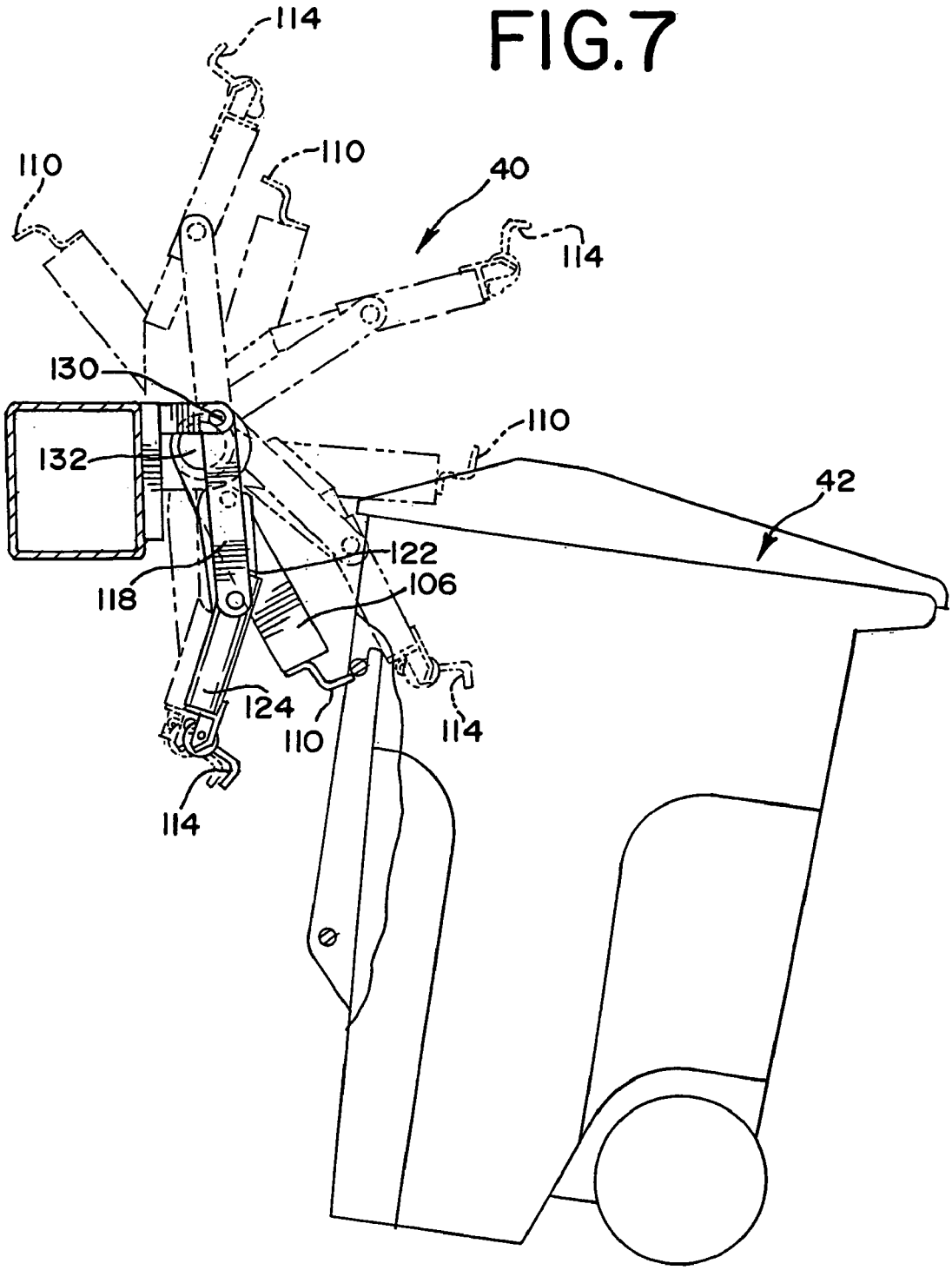
FIG. 7 is a side view of the lifter of FIG. 3, showing the lifter mounted a larger vertical height than in FIG. 6 and in progressive positions between a lowered or retracted position and a raised position for dumping a container or cart.

The reverse movement takes place during retraction of the lifter. The lift arm are rotated clockwise (as seen in FIGS. 6 and 7), bringing the upper hook to a lowermost position as seen in FIGS. 3, 6 and 7, with the lift arms extending vertically downward. The relative spacing between the axes of rotation 130 and 132 cause the rod and cylinder to telescope together reducing the distance between the hooks and raising the lower hook.

As is apparent from the drawings (e.g., FIG. 3), when the lifter is in the retracted position the actuator and lift arms are located in a low-profile, nesting arrangement in which the actuator and lift arms extend substantially vertically downward, with the first actuator arm 116 being located between the lift arm 106 and second actuator arm 118. The lift arm is of sufficient length that when in the retracted position, the upper hook 110 is located just above, or proximal to the lower hook 114.

Although the dimensions may vary, the lifter in accordance with the present invention may have a total length (in the retracted position) of about 23⅛ inches, a width of about 21⅞ inches and a depth or thickness of about 6 inches. Such a lifter may be mounted at a height of from about 35½ inches up to about 53½ inches, and still work well in lifting and dumping typical collection carts in containers having an upper lift bar at about 34–35 inches above ground level. With the illustrated features of the present invention, the upper and lower hooks are in proximity when retracted but spaced apart (e.g., 14–15 inches apart) in the dumping position to capture the lift surfaces of the container.

Because the upper hook rotates upwardly from an extreme lower position, it is able to engage under the upper lift surface in its normal path of travel, and it is unnecessary for the operator to lift or tilt the container in order to engage it properly with the upper hook.

Although described in terms of the illustrated and preferred embodiments, the present invention is not limited to the exact form or variety shown, and may take such other forms as may be immediately apparent from the above description or which may become apparent only after some study of the above lifter.

The invention claimed is:

1. A refuse receptacle lifter movable between a retracted and a dumping position for lifting and inverting refuse receptacles of the type including spaced apart upper and lower engagement surfaces, the lifter comprising;

a base;

an actuator carried by the base and having a rotary output shaft;

a lift arm including a first end and a second end and being movable such that rotation of the rotary output shaft results in pivotal movement of the lift arm;

an upper engagement member carried at least in part by the lift arm;

a first actuator arm having first and second ends, the first end being pivotally mounted to a selected one of the base or the lift arm;

a second actuator arm having first and second ends, the first end being pivotally mounted to a selected one of the base or the lift arm;

an extension assembly comprising first and second relatively movable members, the first member being attached to the second end of the first actuator arm and the second member being attached to the second end of the second actuator arm;

a lower engagement member carried by a selected one of the first and second members of the extension assembly;

whereby upon rotation of the output shaft, the upper engagement member is moved between a lower retracted position and a raised position to lift an upper engagement surface of a refuse receptacle, and the lower engagement member is moved between a retracted position and an extended position for engagement with a lower engagement surface of a refuse receptacle when it is lifted and inverted.

2. The lifter of claim 1 in which the lift arm and actuator arms are disposed in generally overlapping relation when the lifter is in a retracted position.

3. The lifter of claim 1 in which the rotary output shaft has ends in opposed relation, the lift arm is attached to one end of the output shaft, a separate lift arm is attached to the other end of the output shaft, and the upper engagement member is carried on a cross bar that extends between the second end of the lift arm and a second end of the separate lift arm.

4. The lifter of claim 1 in which the lift arm is elongated and extends to a location whereby the upper engagement member is proximal to the lower engagement member when the lifter is in a retracted position.

5. The lifter of claim 1 in which the first actuator arm is pivotally mounted to the lift arm at a location proximal to the first end of the lift arm.

6. The lifter of claim 1 in which one of the first and second member comprises an inner telescoping member and the other comprises an outer telescoping member.

7. The lifter of claim 6 in which the telescoping member attached to the second actuator arm carries the lower receptacle engagement member.

8. The lifter of claim 1 in which the actuator is a rotary hydraulic actuator.

9. The lifter of claim 1 in which the first actuator arm is pivotally mounted to the lift arm.

10. The lifter of claim 1 in which the second actuator arm is pivotally mounted to the base.

11. The lifter of claim 1 in which the first actuator arm is pivotally mounted to the lift arm between the ends of the lift arm.

* * * * *